US009776699B1

(12) United States Patent
Alby et al.

(10) Patent No.: US 9,776,699 B1
(45) Date of Patent: Oct. 3, 2017

(54) OUTBOARD MOTOR WITH ANGLED STEERING AXIS

(71) Applicant: Brunswick Corporation, Lake Forest, IL (US)

(72) Inventors: Jeremy L. Alby, Oshkosh, WI (US); Charles H. Eichinger, Oshkosh, WI (US); Randall J. Poirier, Fond du Lac, WI (US); Robert W. Stuber, Rosendale, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/146,306

(22) Filed: May 4, 2016

Related U.S. Application Data

(60) Provisional application No. 62/265,722, filed on Dec. 10, 2015.

(51) Int. Cl.
*B63H 20/08* (2006.01)
*B63H 20/12* (2006.01)
*B63H 20/06* (2006.01)

(52) U.S. Cl.
CPC ..... *B63H 20/12* (2013.01); *B63H 20/06* (2013.01)

(58) Field of Classification Search
CPC ..... B63H 20/12; B63H 20/06; B63H 20/08
See application file for complete search history.

(56) References Cited

U.S. PATENT DOCUMENTS 3,310,021 A * 3/1967 Shimanckas ..... B63H 20/12 440/52
4,355,986 A * 10/1982 Stevens ..... B63H 20/08 248/640
4,482,332 A 11/1984 Emmons
5,102,357 A 4/1992 Bruesch et al.
5,154,654 A * 10/1992 Yamazaki ..... B63H 20/245 440/88 R
6,146,220 A 11/2000 Alby et al.
6,183,321 B1 * 2/2001 Alby ..... B63H 20/08 440/53
7,896,304 B1 3/2011 Eichinger et al.
2002/0146946 A1 * 10/2002 Shibata ..... B63H 20/26 440/88 J

FOREIGN PATENT DOCUMENTS

JP 2008162331 A 7/2008

* cited by examiner

*Primary Examiner* — Stephen Avila
(74) *Attorney, Agent, or Firm* — Andrus Intellectual Property Law, LLP

(57) ABSTRACT

An outboard motor has a drive unit including an engine rotating output shaft and a driveshaft extending along a driveshaft axis and having an upper end coupled in torque-transmitting relationship with the output shaft. A propulsor shaft extends along a propulsor shaft axis and has a first end coupled in torque-transmitting relationship to a lower end of the driveshaft and a second end coupled to a propulsor. The propulsor shaft axis defines a direction of thrust generated by the propulsor. A transom bracket couples the drive unit to the marine vessel. A steering support couples the drive unit to the transom bracket and rotates the drive unit about a steering axis to change a direction of the thrust generated by the propulsor. The steering axis is substantially non-parallel to the driveshaft axis, and is oriented with respect to the driveshaft axis at a given angle of less than 45 degrees.

20 Claims, 5 Drawing Sheets

OUTBOARD MOTOR WITH ANGLED STEERING AXIS

CROSS REFERENCE TO RELATED APPLICATION

The present application claims the benefit of U.S. Provisional Application Ser. No. 62/265,722, filed Dec. 10, 2015, which is hereby incorporated herein.

FIELD

The present disclosure relates to outboard motors and steering thereof.

BACKGROUND

U.S. Pat. No. 4,482,332 discloses an arrangement for steerably mounting an outboard motor on a boat in which the mounting is effected such that the steering axis of rotation of the motor is angled rearwardly so that the center of gravity of the motor lies at or forward of the axis. The outboard motor has a lower pivotal attachment point generally forward of the motor drive shaft and preferably above and/or forward of the hydrodynamic center of pressure on the lower motor gear case housing. The upper pivotal attachment of the outboard motor may be effected by a single pivot point generally rearward of the motor drive shaft or by the provision of a virtual pivot point to provide the desired angle for the axis of rotation. The virtual pivot point is obtained through the use of a linkage arrangement including a pair of links. The links are pivotally attached to the rear of the boat at their first ends and pivotally attached on opposite sides of the lower gear case housing at their other ends.

U.S. Pat. No. 6,183,321, which is hereby incorporated by reference, discloses an outboard motor having a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure is of an outboard motor configured to be coupled to a marine vessel. The outboard motor has a drive unit including an engine that rotates an output shaft and a driveshaft extending along a driveshaft axis and having an upper end coupled in torque-transmitting relationship with the output shaft. A propulsor shaft extends along a propulsor shaft axis and has a first end coupled in torque-transmitting relationship to a lower end of the driveshaft and a second end coupled to a propulsor. The propulsor shaft axis defines a direction of thrust generated by the propulsor. A transom bracket is configured to couple the drive unit to the marine vessel. A steering support couples the drive unit to the transom bracket and is configured to rotate the drive unit about a steering axis to change a direction of the thrust generated by the propulsor. The steering axis is substantially non-parallel to the driveshaft axis, and is oriented with respect to the driveshaft axis at a given angle of less than 45 degrees.

In another example of the present disclosure, a steering and support system for coupling an outboard motor to a transom of a marine vessel includes a first bracket configured to be attached to the transom and a second bracket pivotally attached to the first bracket along a horizontal tilt-trim axis and at least partly supporting the outboard motor such that the outboard motor can be raised and lowered as the second bracket pivots with respect to the first bracket. A swiveling support assembly is pivotally attached to the second bracket along a steering axis and has an upper end a lower end configured to connect to the outboard motor such that the outboard motor can be steered as the swiveling support assembly pivots with respect to the second bracket. The steering axis is oriented at a given angle between about 2 degrees and about 10 degrees from vertical when the second bracket is not pivoted about the tilt-trim axis.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Overall handling or stability of an outboard motor is driven by several key factors, such as the location of the overall drive unit center of gravity ("CG") and center of pressure ("CP") of the hydrodynamic loads on the gear case. Handling and/or stability issues can occur if the setback (distance) of the center of gravity from the steering axis is too high. Such a problem is especially of concern with a four-stroke engine, which has a CG situated further back from the steering axis than does a two-stroke engine.

Some prior art solutions attempt to move the physical sprung mass of the outboard's engine forward toward the steering axis to improve stability. This generally results in a wider or taller and potentially heavier engine.

Conventional outboard designs utilize a swivel bracket for steering the outboard, which has a steering axis parallel to the driveshaft axis. This allows for a shift shaft connected to the outboard's transmission, which is in the gear case, to run through the swivel tube in the swivel bracket down to the gear case without taking up extra space.

In contrast, in the outboard motor of the present disclosure, the steering axis is tilted such that the steering axis is not parallel to the driveshaft axis. Although the steering axis still extends in a more-or-less up and down direction such that the outboard can be steered to port and starboard, the steering axis is not parallel to vertical, even when the outboard motor is not pivoted about its tilt-trim axis. This in turn reduces the distance from the steering axis to the CG and increases the distance to the CP. Both of these consequences are directionally correct to provide improved handling and stability over a conventional outboard motor with a steering axis that is parallel to the driveshaft axis and extends vertically.

Figure 1:
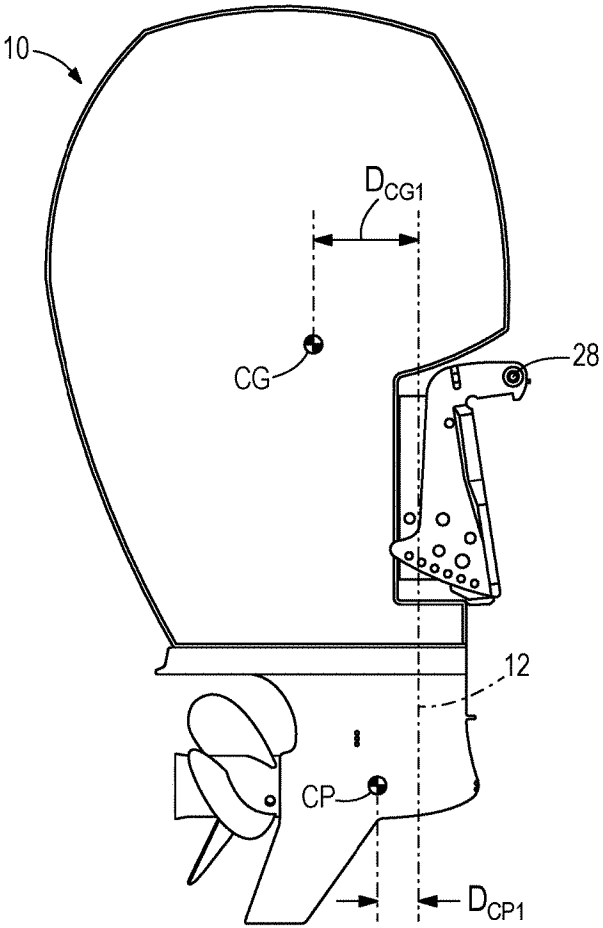
FIG. 1 PRIOR ART
FIG. 1 illustrates an outboard motor according to the prior art.
Figure 3:
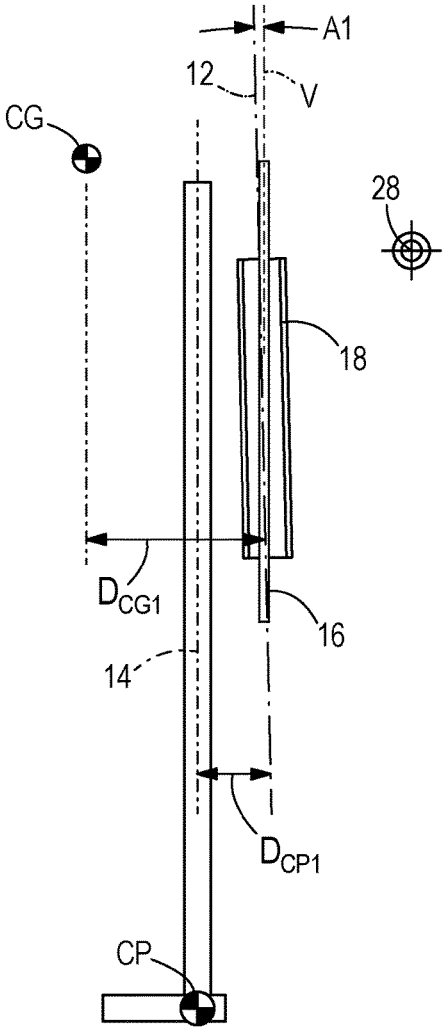
FIG. 3 PRIOR ART
FIG. 3 illustrates dimensions between a center of gravity of the prior art outboard motor and its steering axis, and a center of pressure of the outboard motor and the steering axis.

Referring to FIG. 1, the prior art outboard motor 10 shown therein has a steering axis 12 that is substantially vertically oriented when the outboard motor 10 is not pivoted (i.e. tilted or trimmed) about its tilt-trim axis 28. As shown in FIG. 3, this also means the steering axis 12 is substantially parallel to the driveshaft axis 14, which is parallel to vertical V when the outboard motor 10 is not pivoted about its tilt-trim axis 28. In actuality, the steering axis 12 is situated at an angle of A1 from vertical V (where A1, in one example, is between 0.01 and 1 degrees, or more specifically 0.83 degrees) in order to provide room for the shift shaft 16 to move within the cylinder of the swivel tube 18. Because it is undesirable for the shift shaft 16 to hit the inside surface of the swivel tube 18, the axis of the swivel tube 18 is biased a bit to provide room for the shift shaft 16 to move as the outboard motor 10 moves on its mounts. However, such a bias at the angle A1 is not substantial enough to positively affect the handling or stability of the outboard motor 10. In FIG. 3, the steering axis 12 is therefore considered to be substantially parallel to the driveshaft axis 14.

In FIGS. 1 and 3, the steering axis 12 is at a lateral distance $D_{CG1}$ from the center of gravity (CG) and at a lateral distance $D_{CP1}$ from the center of pressure (CP). Both distances are the shortest distances between the points CG, CP, respectively, and the line 12 representing the steering axis, and as such are perpendicular distances.

Figure 2:
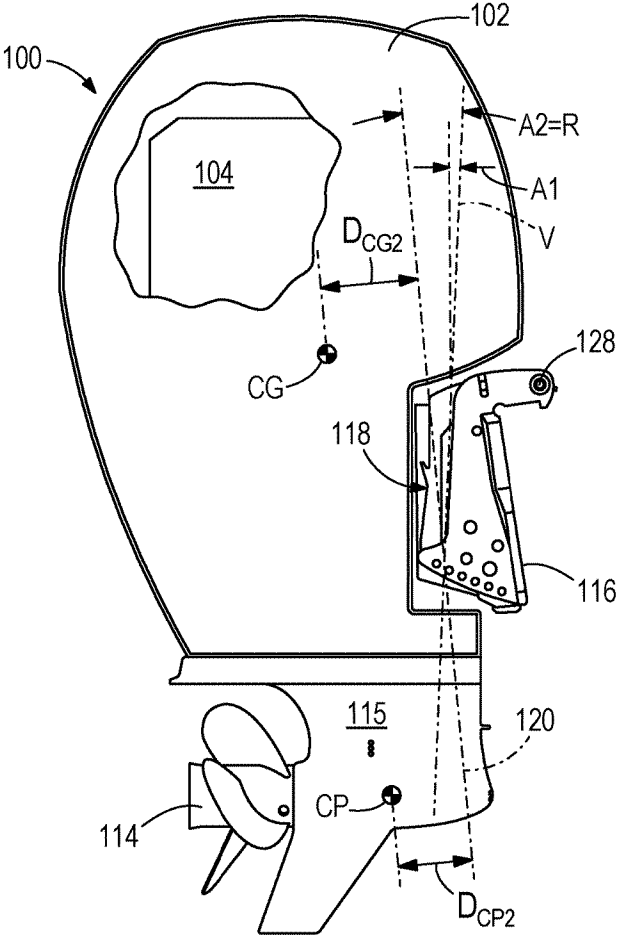
FIG. 2 illustrates an outboard motor according to the present disclosure.
Figure 4:
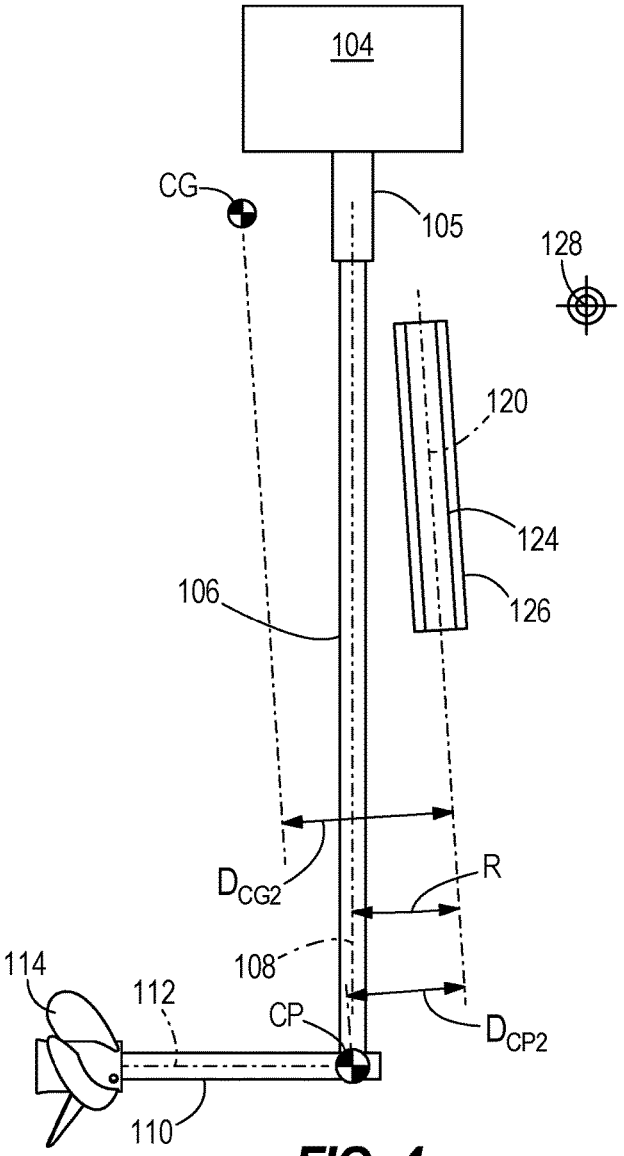
FIG. 4 illustrates dimensions between a center of gravity of the outboard motor of the present disclosure and its steering axis, and a center of pressure of the outboard motor and the steering axis.

Referring now to FIGS. 2 and 4, an outboard motor 100 according to the present disclosure has a drive unit 102 including an engine 104 that rotates an output shaft 105 and a driveshaft 106 extending along a driveshaft axis 108 and having an upper end coupled in torque-transmitting relationship with the output shaft 105. A propulsor shaft 110 extends along a propulsor shaft axis 112 and has a first end coupled in torque-transmitting relationship to a lower end of the driveshaft 106 and a second end coupled to a propulsor 114. The propulsor 114 could be a propeller as shown herein or an impeller, jet propulsor, or any other type of propulsor known in the art. The propulsor shaft axis 112 defines a direction of thrust generated by the propulsor 114. A transom bracket 116 is configured to couple the drive unit 102 to the marine vessel. A steering support 118 couples the drive unit 102 to the transom bracket 116 and is configured to rotate the drive unit 102 about a steering axis 120 to change a direction of the thrust generated by the propulsor 114. Referring specifically to FIG. 4, the steering axis 120 is substantially non-parallel to the driveshaft axis 108, and is oriented with respect to the driveshaft axis 108 at a given angle R of less than 45 degrees.

Figure 5:
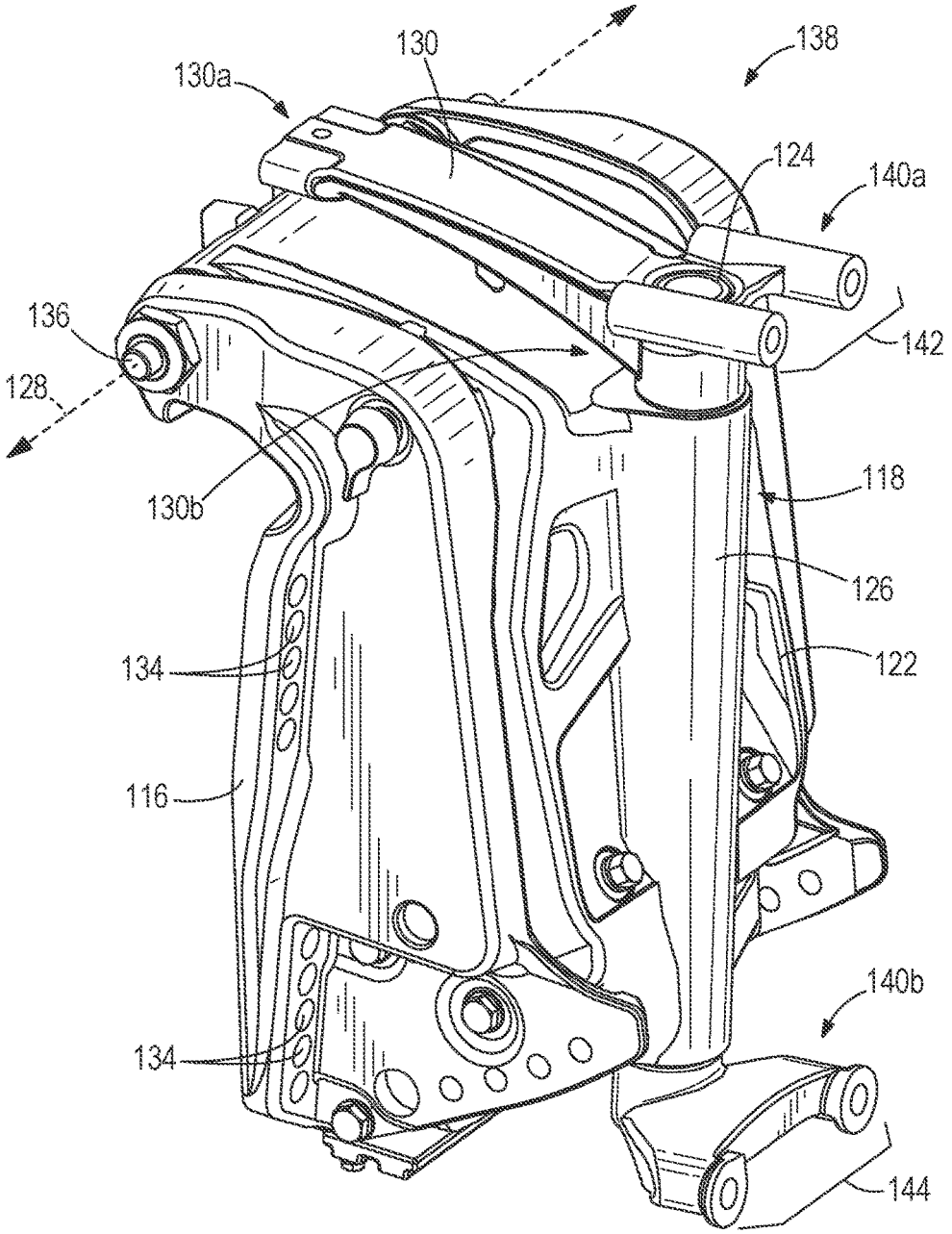
FIG. 5 illustrates a perspective view of a mounting and steering arrangement for an outboard motor according to the present disclosure.
Figure 6:
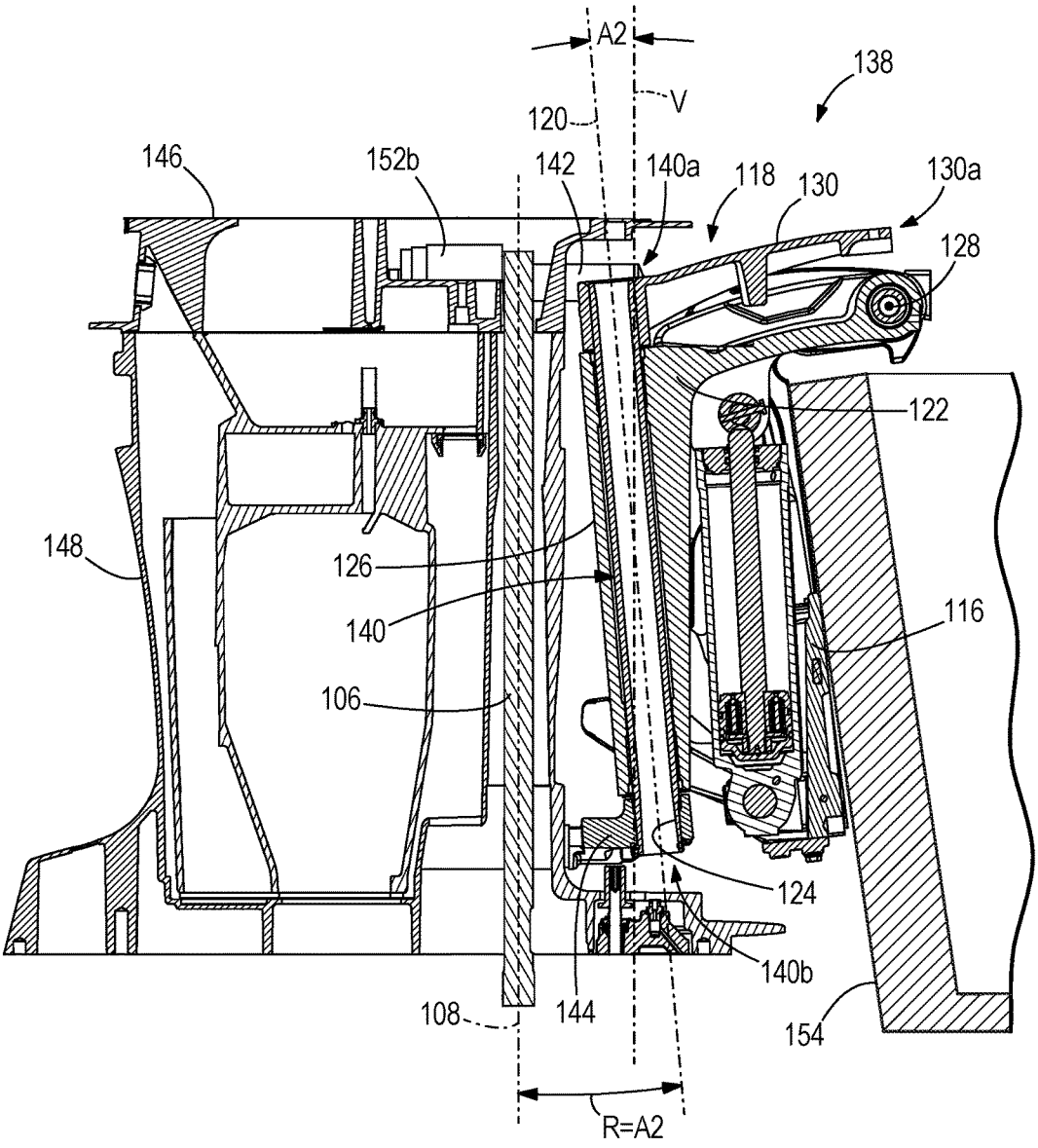
FIG. 6 illustrates a cross-sectional view of a midsection of an outboard motor according to the present disclosure.

As shown in FIGS. 5 and 6, the steering support 118 comprises a swivel bracket 122 having a tubular housing 126, within which a swivel tube 124 is rotatably disposed. The swivel tube 124 and the tubular housing 126 extend along a majority of a vertical height of a driveshaft housing 148 of the drive unit. A steering arm or upper yoke 130 couples the swivel tube 124 to a steering actuator (not shown), which can be a hydraulic actuator, an electromechanical actuator, a mechanical actuator, or any other type of steering actuator known to those having ordinary skill in the art. In one example, the steering arm 130 and the swivel tube 124 are integral with one another. A longitudinal axis of rotation of the swivel tube 124 defines the steering axis 120. Thus, both the swivel tube 124 and the tubular housing 126 are oriented at the given angle R with respect to the driveshaft axis 108. As is known, the swivel bracket 122 rotates with respect to the transom bracket 116 around a horizontal tilt/trim axis 128 so as to tilt and trim (pivot) the drive unit 102 up and down with respect to the marine vessel.

Comparing FIGS. 1 and 2, a shortest distance $D_{CP2}$ between the center of hydrodynamic pressure CP of the outboard motor 100 and the steering axis 120 is greater than it would otherwise be if the steering axis 120 were parallel to the driveshaft axis 108. In other words, $D_{CP2}>D_{CP1}$. Additionally, a shortest distance $D_{CG2}$ between a center of gravity CG of the outboard motor 100 and the steering axis 120 is less than it would otherwise be if the steering axis 120 were parallel to the driveshaft axis 108. In other words, $D_{CG2}<D_{CG1}$. This increases handling and stability of the outboard motor 100 over the outboard motor 10.

In both FIGS. 1 and 3, the center of gravity CG and the center of pressure CP are located in the same place, and are aft of the steering axis 12 or 120. Ideally, the CG would be in front of the steering axis 12 or 120 in order to provide the best handling. This is because when the CG is on the aft side of the steering axis, the mass of the drive unit 102 provides an additional force in the direction of the turn and tends to cause the outboard motor to oversteer. However, because placing the CG ahead of the steering axis 12 or 120 creates a much wider or taller and heavier engine and therefore creates problems when trying to package more than one outboard on a vessel, this is not an ideal solution. Tilting the steering axis 120 as described in the present disclosure provides improved handling and stability without needing to increase the size of the outboard motor fore of the steering axis.

Having the CP further from the steering axis 120 also increases handling and stability. For example, if the system is disturbed by a steering input, the CP (when behind the steering axis 120) provides a restoring force to bring the system to the requested steering angle without oversteering. The further the CP is behind the steering axis 120, the more authority it has to stabilize the system. However, if the CP is too far behind the steering axis, steering forces required to steer the outboard 100 become too high. Thus, the tradeoff between limiting oversteering due to having a CG behind the steering axis, and requiring too high of steering system forces when the CP is too far behind the steering axis must be balanced when determining the angle R at which to tilt the steering axis 120.

Note that the angle R is measured from vertical, assuming that the driveshaft axis 108 is also vertical when the outboard motor 100 is not tilted/pivoted about the tilt/trim axis 128. Note also that in order for the distance $D_{CG2}$ from the steering axis 120 to the CG to be decreased by tilting the steering axis 120, the tilt must be such that the top of the swivel tube 124 moves away from the transom bracket 116 and toward the drive unit 102.

In order to determine the center of gravity, a computer program can be used to find the average location of the weight of a solid model of the all outboard components that are steered, such as for example excluding the transom bracket 116 and the tilt-trim system, which are bolted to the transom. Because the CG is also the point where if force is applied, the drive unit 102 will move in the direction of the force without rotation, the CG can also be determined experimentally by hanging the drive unit 102 in many different directions and noting the axes along which it hangs. The CG is at the intersection point of the lines defining the different directions of hanging. The center of pressure, then, is a side force on the gear case 115, and represents the location of a single point where a vector sum of all hydrodynamic forces acts perpendicularly with respect to the gear case 115. The CP is calculated using computational fluid dynamics (CFD) and is not experimentally determined. In the example shown herein, the CP is shown at the intersection of the drive shaft 106 and propeller shaft 110. This is a good reference point to dimension the CP from, but the CP isn't necessarily at the shaft intersection and varies with submersion height, trim angle, and gear case shape. Generally, the CP is usually within a few inches fore, aft, up and/or down of this intersection, and thus the principles discussed herein above regarding moving the steering axis 120 away from the CP still apply.

To determine what the given angle R should be to improve handling, an iterative process can be used. Shims can be placed between the main body of the swivel bracket 122 and the swivel tube 124 to angle the swivel tube 124 outward away from the vessel's transom. A different thickness and/or number of shims can be used to experimentally test a number of steering axis angles while measuring results aboard a running marine vessel. For example, with hydraulic steering systems, steering pressure measurements can be taken at different tilts of the steering axis 120 to see at what steering axis angle R the pressure is the least for the same degree of turn. The vessel's oscillations can also be measured with a gyroscope and/or a transducer to see which steering axis angle R results in the least frequent and/or lowest amplitude of oscillations. An experienced driver may also execute a number of different maneuvers and report his or her opinion regarding how the boat moves, how the outboard moves, and how feedback at the steering wheel feels at different steering axis angles.

Any tested angles that had relatively good results can then be examined for other factors such as outboard motor packaging. For instance, the upper end of the steering axis 120 and swivel tube 124 can only be tilted so far away from the transom before they will interfere with the cowl, the driveshaft housing, etc. of the outboard motor 100. In other words, while tilting the steering axis 120 to the angle R does not "fix" the problem of oversteering altogether as might situating the CG fore of the steering axis, the steering axis 120 can be tilted as much as the outboard 100 can tolerate given its packaging so as to move the CG closer to the steering axis 120 and thereby provide at least somewhat improved handling and steering.

In one example, the given angle R is between about 2 degrees and about 10 degrees. In another example, the given angle R is between about 3 degrees and about 7 degrees. For example, the given angle can be about 5 degrees, or more specifically, 4.75 degrees. These angles orient the steering axis 120 such that it is substantially non-parallel to the driveshaft axis 108 (and substantially non-vertical) because they are significant enough to positively affect the handling and steering of the outboard motor 100 in measurable ways and in ways that can be felt by an experienced driver. This is in contrast to the insubstantial 0.83 degree tilt of the steering axis shown in FIGS. 1A and 2A. Of course, the steering axis 120 still needs to extend in a generally up-and-down direction so that the outboard motor 100 can be steered to port and starboard in order to affect the vessel's direction. Thus, a steering axis angle of less than 45 degrees with respect to vertical is required.

Because the swivel tube 124 of the present disclosure is tilted at the angle R, additional changes must be made to the shifting assembly. If a mechanical shift shaft is still to be used, alternative placement or a linkage design (e.g., bell cranks, sprockets and chain, sector gear sets, etc.) could be used. Alternatively, the shift shaft could be supported inside the swivel tube 124 with additional joints (e.g., single or double cardon joints, constant velocity joints, coil spring universal joints, etc.) added above and below the swivel bracket 122 to transfer the shifting torque through the new swivel tube angle R and to allow for the required mount relative motion. These joints could transfer the torque through the angular difference between the swivel tube-contained shift shaft and the mating shift shaft components. These joints could also allow for the positional movement that the engine mounts allow between the swivel tube/bracket and the mount-suspended outboard 100. Additionally, if the shift shaft were located inside the swivel tube 124, it could be supported by bearings in the tube. In the present disclosure, however, the shifting mechanism is an electronic servomechanism, which does not require a shift shaft that runs the length of the swivel bracket 122.

It should be noted that the angle of the steering axis 120 need not be defined with respect to the driveshaft axis 108. Instead, the present disclosure covers any embodiment of a steering and support system for an outboard motor 100 wherein the steering axis 120 is angled such that the clearance between the CG and the steering axis 120 is minimized while the clearance between the CP and the steering axis 120 is maximized, without negatively affecting vessel handling. Additionally, it should be noted that the exact type and configuration of steering and support system shown herein is not limiting on the scope of the present disclosure. For instance, the present disclosure applies equally to steering and support systems such as those disclosed in U.S. Pat. Nos. 6,183,321; 6,146,220; and 7,896,304, which are hereby incorporated by reference herein.

Thus, with reference to FIGS. 5 and 6, the present disclosure is of a steering and support system 138 for coupling an outboard motor 100 to a transom 154 of a marine vessel. The steering and support system 138 comprises a first bracket 116 configured to be attached to the transom 154. For instance, the first bracket 116 can be attached to the transom 154 by way of fasteners such as bolts that extend through holes 134 (FIGS. 5 and 7) in the first bracket 116. The steering and support system 138 may also include a second bracket 122 pivotally attached to the first bracket 116 along a horizontal tilt-trim axis 128. For instance, this can be done by way of a rod 136 extending through horizontally-extending tubular portions of both the first bracket 116 and the second bracket 122 near the upper end of each bracket, as is conventional. The second bracket 122 at least partly supports the outboard motor 100 such that the outboard motor 100 can be raised and lowered as the second bracket 122 pivots with respect to the first bracket 116. This is a normal tilt-trim function of a steering and support system 138 and can be accomplished via trim actuators connected between the first bracket 116 and the second bracket 122, such as but not limited to hydraulic actuators as mentioned above.

A swiveling support assembly 140 is pivotally attached to the second bracket 122 along the steering axis 120. Referring to FIG. 5, the swiveling support assembly 140 has an upper end 140*a* configured to connect to the outboard motor 100 at bracket 142 and a lower end 140*b* configured to connect to the outboard motor 100 at bracket 144 such that the outboard motor 100 can be steered as the swiveling support assembly 140 pivots with respect to the second bracket 122. According to the present disclosure, the steering axis 120 is oriented at a given angle A2 (FIGS. 2 and 6) between about 2 degrees and about 10 degrees from vertical V when the second bracket 122 is not pivoted about the tilt-trim axis 128. In other words, when the second bracket 122 is not pivoted about the tilt-trim axis 128, the outboard motor 100 is not trimmed or tilted, but is at a neutral rest position in which generally, its driveshaft axis 108 is also vertically oriented. In other words, the driveshaft axis 108 is vertical when the second bracket 122 is not pivoted about the tilt-trim axis 128. Thus, A2=R as long as the driveshaft axis 108 is vertical under such circumstances.

Figure 7:
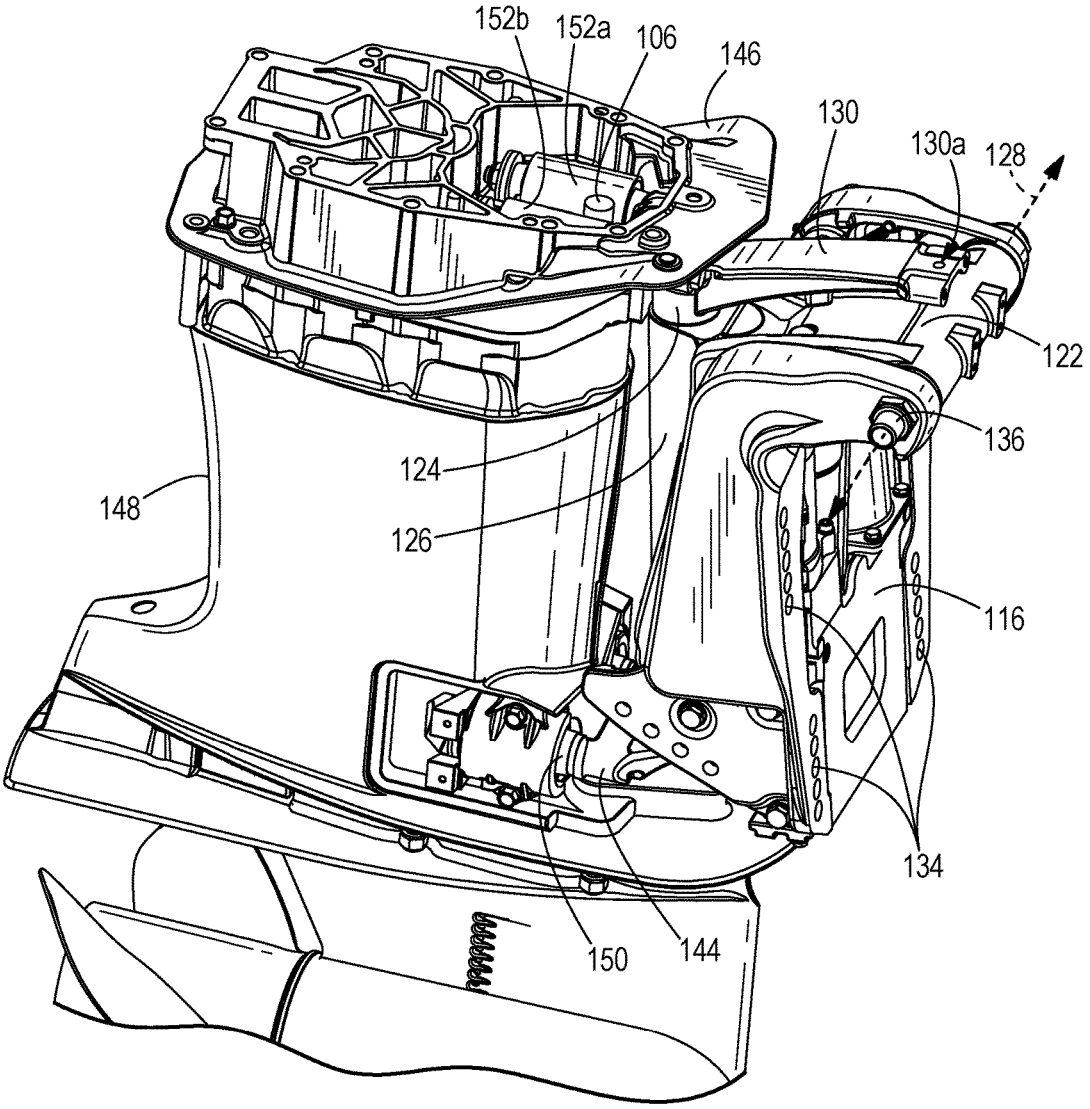
FIG. 7 illustrates another view of the midsection of the outboard motor and the mounting and steering arrangement therefor.

According to the example shown herein, the second bracket 122 comprises a tubular housing 126, and the swiveling support assembly 140 comprises a swivel tube 124 rotatably disposed within the tubular housing 126. The upper end 140*a* of the swiveling support assembly includes a yoke 130 connected to the swivel tube 124, wherein a fore end 130*a* of the yoke 130 is configured to be connected to a steering actuator, such a connection being made in any conventional manner. An aft end 130*b* of the yoke 130 includes an upper attachment bracket 142 configured to be connected to the outboard motor 100, and the lower end 140*b* of the swiveling support assembly includes a lower attachment bracket 144 connected to the swivel tube 124 and configured to be connected to the outboard motor 100. As shown in FIG. 7, the upper attachment bracket 142 is configured to be connected to an adapter plate 146 of the outboard motor 100 and the lower attachment bracket 144 is configured to be connected to a driveshaft housing 148 of the outboard motor 100. The outboard motor 100 could alternatively be one that has no adapter plate, in which case the upper attachment bracket 142 could be connected to the driveshaft housing 148 as well, or to the powerhead area of the outboard motor 100. For instance, the attachment brackets 142, 144 can be connected to the outboard motor 100 by way of vibration isolation mounts, such as mount 150 shown on lower attachment bracket 144. A similar mount may be provided on the opposite side of the driveshaft housing 148, and mounts may also be provided at the aft ends of the upper attachment bracket 142 (see 152*a*, 152*b*).

Another way to describe the fact that the steering axis is angled such that the distance between the CG and the steering axis 120 is minimized while the distance between the CP and the steering axis 120 is maximized is to say that the steering axis 120 at the upper end 140*a* of the swiveling support assembly 140 is aft of the steering axis 120 at the lower end 140*b* of the swiveling support assembly 140. Note again that this difference between the locations of the steering axis 120 at the upper and lower ends of the swiveling support assembly 140 must be substantial enough that is has a positive effect on handling of the vessel, but not so much that the effect on handling becomes negative. For instance, as described herein above, in one example, the given angle A2 at which the steering axis 120 is angled from vertical V is between about 2 degrees and about 10 degrees. In another example, the given angle A2 is between about 3 degrees and about 7 degrees. For example, the given angle A2 can be about 5 degrees, or more specifically, 4.75 degrees. This is in contrast to the angle being only between about 0.01 and 1 degrees, as in known systems.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

What is claimed is:

1. An outboard motor configured to be coupled to a marine vessel, the outboard motor comprising:

a drive unit including:

an engine that rotates an output shaft;

a driveshaft extending along a driveshaft axis and having an upper end coupled in torque-transmitting relationship with the output shaft; and a propulsor shaft extending along a propulsor shaft axis and having a first end coupled in torque-transmitting relationship to a lower end of the driveshaft and a second end coupled to a propulsor, the propulsor shaft axis defining a direction of thrust generated by the propulsor;

a transom bracket configured to couple the drive unit to the marine vessel; and a steering support coupling the drive unit to the transom bracket and configured to rotate the drive unit about a steering axis to change the direction of thrust generated by the propulsor;

wherein the steering axis is substantially non-parallel to the driveshaft axis when the driveshaft axis is vertically oriented, and the steering axis is oriented with respect to the driveshaft axis at a given angle of less than 45 degrees when the driveshaft axis is vertically oriented.

2. The outboard motor of claim 1, wherein the steering support comprises a swivel bracket including a tubular housing within which a swivel tube is rotatably disposed.

3. The outboard motor of claim 2, wherein a longitudinal axis of rotation of the swivel tube defines the steering axis.

4. The outboard motor of claim 3, wherein both the swivel tube and the tubular housing are oriented at the given angle with respect to the driveshaft axis.

5. The outboard motor of claim 4, wherein the swivel bracket rotates with respect to the transom bracket around a horizontal tilt/trim axis so as to change a position of the propulsor with respect to a surface of a body of water in which the marine vessel is operating.

6. The outboard motor of claim 1, wherein a shortest distance between a center of hydrodynamic pressure of the outboard motor and the steering axis is greater than it would otherwise be if the steering axis were parallel to the driveshaft axis.

7. The outboard motor of claim 6, wherein a shortest distance between a center of gravity of the outboard motor and the steering axis is less than it would otherwise be if the steering axis were parallel to the driveshaft axis.

8. The outboard motor of claim 7, wherein the center of gravity and the center of hydrodynamic pressure are located aft of the steering axis.

9. The outboard motor of claim 1, wherein the given angle is between about 2 degrees and about 10 degrees.

10. The outboard motor of claim 9, wherein the given angle is about 5 degrees.

11. A steering and support system for coupling an outboard motor to a transom of a marine vessel, the steering and support system comprising:

a first bracket configured to be attached to the transom;

a second bracket pivotally attached to the first bracket along a horizontal tilt-trim axis and at least partly supporting the outboard motor such that the outboard motor can be raised and lowered as the second bracket pivots with respect to the first bracket; and a swiveling support assembly pivotally attached to the second bracket along a steering axis and having an upper end and a lower end configured to connect to the outboard motor such that the outboard motor can be steered as the swiveling support assembly pivots with respect to the second bracket;

wherein the steering axis is oriented at a given angle between about 2 degrees and about 10 degrees from vertical when the second bracket is not pivoted about the tilt-trim axis.

12. The steering and support system of claim 11, wherein the second bracket comprises a tubular housing and the swiveling support assembly comprises a swivel tube rotatably disposed within the tubular housing.

13. The steering and support system of claim 12, wherein the upper end of the swiveling support assembly includes a yoke connected to the swivel tube, and wherein a fore end of the yoke is configured to be connected to a steering actuator.

14. The steering and support system of claim 13, wherein an aft end of the yoke includes an upper attachment bracket configured to be connected to the outboard motor, and the lower end of the swiveling support assembly includes a lower attachment bracket connected to the swivel tube and configured to be connected to the outboard motor.

15. The steering and support system of claim 14, wherein the upper attachment bracket is configured to be connected to an adapter plate of the outboard motor and the lower attachment bracket is configured to be connected to a driveshaft housing of the outboard motor.

16. The steering and support system of claim 12, wherein both the swivel tube and the tubular housing are oriented at the given angle from vertical.

17. The steering and support system of claim 11, wherein the given angle from vertical is between about 3 degrees and about 7 degrees.

18. The steering and support system of claim 17, wherein the given angle from vertical is about 5 degrees.

19. The steering and support system of claim 11, wherein the outboard motor has a driveshaft that extends along a driveshaft axis which is vertical when the second bracket is not pivoted about the tilt-trim axis.

20. The steering and support system of claim 11, wherein the steering axis at the upper end of the swiveling support assembly is aft of the steering axis at the lower end of the swiveling support assembly when the second bracket is not pivoted about the tilt-trim axis.

* * * * *